US006276402B1

(12) United States Patent
Herring

(10) Patent No.: US 6,276,402 B1
(45) Date of Patent: Aug. 21, 2001

(54) MULTILAYER PAPERMAKERS FABRIC

(75) Inventor: Samuel H. Herring, Simpsonville, SC (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/644,075

(22) Filed: Aug. 23, 2000

Related U.S. Application Data

(60) Provisional application No. 60/150,275, filed on Aug. 23, 1999.

(51) Int. Cl.[7] ..... D03D 23/00; D03D 13/00; D21F 1/00

(52) U.S. Cl. ..... 139/383 A; 162/903; 442/207

(58) Field of Search ..... 139/383 A; 162/903; 442/207

(56) References Cited

U.S. PATENT DOCUMENTS 5,169,709 * 12/1992 Fleischer ..... 139/383 A
5,641,001 * 6/1997 Wilson ..... 139/383 A
5,826,627 * 10/1998 Seabrook et al. ..... 139/383 A
5,937,914 * 8/1999 Wilson ..... 139/383 A
5,944,062 * 8/1999 Gampe ..... 139/383 A
5,975,148 * 11/1999 Lee ..... 139/383 A

* cited by examiner

*Primary Examiner*—Andy Falik
(74) *Attorney, Agent, or Firm*—Volpe & Koenig, P.C.

(57) ABSTRACT

A "triple layer" fabric having upper and lower systems of interwoven yarns interconnected into an integral fabric by a system of stitching yarns. Preferably, the fabric is a forming fabric having upper and lower layers of uniformly sized machine direction (MD) yarns. Upper and lower layer cross machine direction (CMD) yarns weave, respectively, with the upper and lower MD yarns to define the upper and lower yarn systems. The lower layer CMD yarns are preferably larger in diameter than the MD yarns. The lower layer CMD yarns weave in a repeat pattern with respect to the lower layer MD yarns such that the lower layer CMD yarns weave in a repeat defined by floats under groups of at least three lower MD yarns and over pairs of adjacent lower MD yarns. Each lower layer MD yarn is in at least two different pairs relative to at least two different lower layer CMD yarns within the repeat which maintains a substantial degree of stacking of the lower layer MD yarns below respective upper layer MD yarns. In an alternative embodiment the stitching yarns are incorporated in the upper layer as upper layer MD yarns where less than one half of the upper layer MD yarns also serve as stitching yarns.

3 Claims, 9 Drawing Sheets

(60, 62, 64, 66, 68)
(61, 63, 65, 67, 69)
II
70
71
72
73
74
80
81
82
83
84

MULTILAYER PAPERMAKERS FABRIC

This application claims the benefit of U.S. Provisional Application No. 60/150,275 filed on Aug. 23, 1999.

BACKGROUND

The present invention relates to papermakers fabrics and, in particular, fabrics intended to facilitate the initial formation of an aqueous paper web in the manufacture of paper.

Papermaking machines generally are comprised of three sections: forming, press, and drying. Papermakers fabrics are employed to transport a continuous paper sheet through the papermaking equipment as it is being manufactured. The direction of travel of the fabric on the papermaking equipment is commonly referred to as the machine direction. The requirements and desirable characteristics of papermakers fabrics vary in accordance with the particular section of the machine where the respective fabrics are utilized.

In particular, in the forming section of papermaking equipment, forming fabrics are utilized to initially create an aqueous paper sheet or web from a pulp slurry. Typically, the pulp slurry is deposited on the top or paper carrying side of the moving forming fabric which transports the slurry over suction boxes or other means to form the paper web. The surface characteristics and drainage characteristics of the forming fabric play an important role in the initial formation of the aqueous paper web.

Multilayer forming fabrics are known in the art. For example, U.S. Pat. No. 5,025,839 discloses a dual layer forming fabric for use in the papermaking process which includes single system of zig zagging machine direction (MD) yarns which interweave with two layers of cross machine direction (CMD) yarns.

U.S. Pat. Nos. 5,013,330; 4,515,853; and 3,885,603 disclose forming and other types of papermakers fabrics having distinct top and bottom interwoven fabric layers which are interconnected by binding or stitching yarns. Such fabrics are generally known as "triple layer" fabrics, the "third" layer being the layer of binding or stitching yarns which interconnects the upper yarn system with the lower yarn system.

Early triple layer fabrics utilized different size machine direction (MD) yarns in the upper and lower fabric layers; the upper MD yarns being roughly one half the diameter than the lower MD yarns with twice as many upper MD yarns than lower MD yarns. Common weave patterns for the bottom or machine side layer were plain weave and 1:3 broken twill.

One of the problems with such triple layer fabrics was the relatively high caliper of the fabric. The high caliper allowed water drained from the aqueous paper web to be carried inside the fabric and caused problems of rewetting of the sheet during forming. Another draw back was that the bottom MD yarns tended to arrange themselves between the top layer MD yarns restricting straight through drainage and the ability to easily clean the fabrics. Also if the bottom MD yarns were not evenly spaced and correctly positioned they could cause "shadow marking" in the paper web formed on the fabric. Non-uniform spacing caused non-uniform drainage which attributed to undesired marking.

To decrease the caliper of triple layer fabrics, the same size MD yarns began to be used in both the top and bottom layers of such fabrics. A draw back to this construction was that in order to maintain the fine mesh top layer, much smaller lower MD yarns were employed which required comparably smaller lower CMD yarns which tended to shorten fabric life. To permit the use of larger CMD bottom yarns for better wear, it was possible to weave the lower MD yarns in pairs which, however, resulted in the reduction of straight through drainage in the fabric since the paired lower MD yarns would block the spaces between the upper MD yarns. It would be desirable to provide a triple layer fabric which permits the use of uniformly sized upper and lower MD yarns in conjunction with larger lower CMD yarns without substantially impairing straight through drainage of the fabric.

SUMMARY

A "triple layer" fabric is provided having upper and lower systems of interwoven yarns interconnected into an integral fabric by a system of stitching yarns. Preferably, the fabric is a forming fabric having upper and lower layers of uniformly sized machine direction (MD) yarns. Upper and lower layer cross machine direction (CMD) yarns weave, respectively, with the upper and lower MD yarns to define the upper and lower yarn systems. A stitching layer of CMD yarns binds the upper and lower yarn system together.

The lower layer CMD yarns are preferably larger in diameter than the MD yarns, the upper layer CMD yarns and the stitching yarns. The lower layer CMD yarns weave in a repeat pattern with respect to the lower layer MD yarns such that the lower layer CMD yarns weave in a repeat defined by floats under groups of at least three lower MD yarns and over pairs of adjacent lower MD yarns. Each lower layer MD yarn is in at least two different pairs relative to at least two different lower layer CMD yarns within the repeat which maintains a substantial degree of stacking of the lower layer MD yarns below respective upper layer MD yarns.

The weave repeat is also selected such that the stitching yarns are woven so as to be recessed within the fabric away from the surfaces defined by the interweaving of the upper MD and CMD yarns and the lower MD and CMID yarns, respectively.

In an alternative embodiment, the stitching yarns are incorporated into the upper layer of the fabric where selected upper layer MD yarns interweave with one or more layer CMD yarns in manner such that the interweavings are recessed from the bottom surface of the fabric. Preferably, less than half of the upper layer MD yarns are selected for the additional stitching function.

Other objects and advantages of the present invention will become apparent from the following description of a presently preferred embodiment.

DETAILED DESCRIPTION OF THE PREFERRED EMBODIMENTS

Referring to FIGS. 1–6, a papermakers fabric I made in accordance with the teachings of the present invention is illustrated. The fabric I is woven with a selected repeat pattern having sixteen upper layer CMD yarns 1–16, eight lower layer CMD yarns 21–28, eight stitching CMD yarns 31–38, eight upper layer MD yarns 41–48 and eight lower layer MD yarns 51–58 within each repeat of the repeated pattern. All of the MD yarns 41–48, 51–58 have substantially the same cross sectional dimension.

Figure 2:
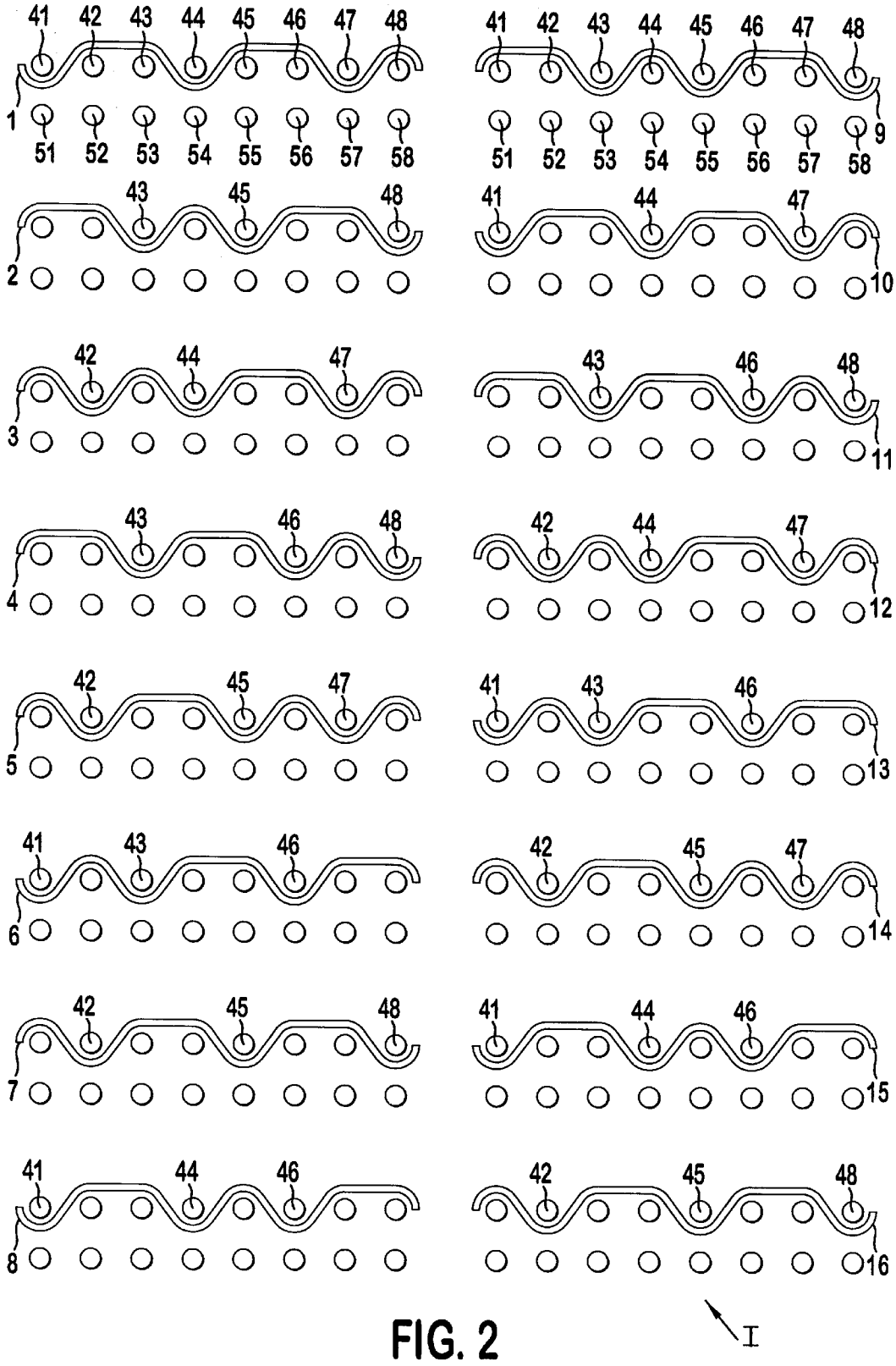
FIG. 2 is a schematic diagram of each of the upper layer CMD yarns within a repeat of the fabric shown in FIG. 1.

As best seen in FIG. 2, an upper layer of CMD yarns 1–16 interweave in a selected pattern exclusively with respect to the upper layer MD yarns 41–48 and do not interweave with the lower MD yarns 51–58. For example, the first CMD yarn 1 within the upper layer CMD repeat only weaves under upper MD yarns 41, 44 and 47 and weaves over all other MD yarns in the fabric I. The preferred weave pattern illustrated for the upper layer of the fabric I includes two, two yarn CMD floats in a broken twill. For CMD yarn 1, the two floats are over upper MD yarns 42, 43 and yarns 45, 46, respectively. Alternative weave patterns for the upper fabric layer weave can readily be employed such as a plain weave or twill patterns with or without MD or CMD floats. Preferably, the upper layer CMD yarns 1–16 are substantially the same size as the MD yarns.

Figure 3:
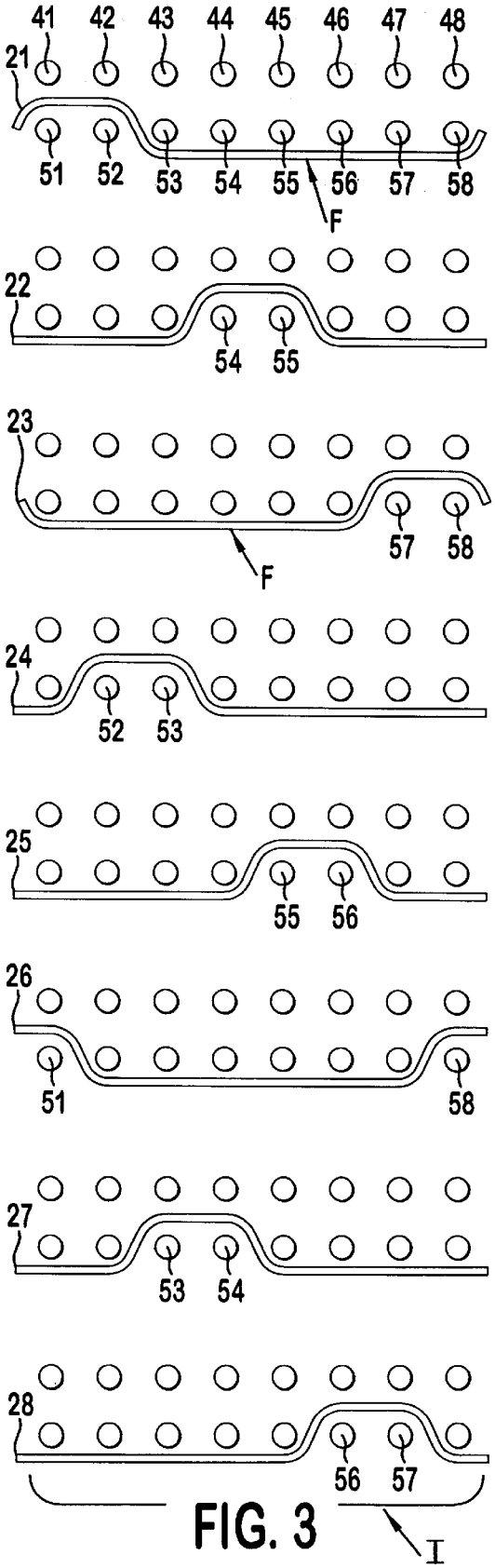
FIG. 3 is a schematic diagram of each of the lower layer CMD yarns within a repeat of the fabric shown in FIG. 1.

As best seen in FIG. 3, the lower layer CMD yarns 21–28 of the fabric I interweave exclusively with the lower layer MD yarns 51–58, but do not weave with the upper layer MD yarns 41–48. The lower layer CMD yarns 21–28 are significantly larger in diameter than the MD yarns 41–48, 51–58, the upper layer CMD yarns 1–16, and the stitching yarns 31–38. Additionally, there are preferably one half as many lower layer CMD yarns 21–28 as there are upper CMD yarns 1–16 within the fabric's repeat pattern.

The repeat of the larger lower layer CMD yarns 21–28 is selected to predominate the bottom surface of the fabric by weaving floats under six adjacent lower MD yarns and over a pair of lower MD yarns. For example, lower CMD yarn 21 weaves over paired lower MD yarns 51, 52 and under lower MD yarns 53–58.

Figure 1:
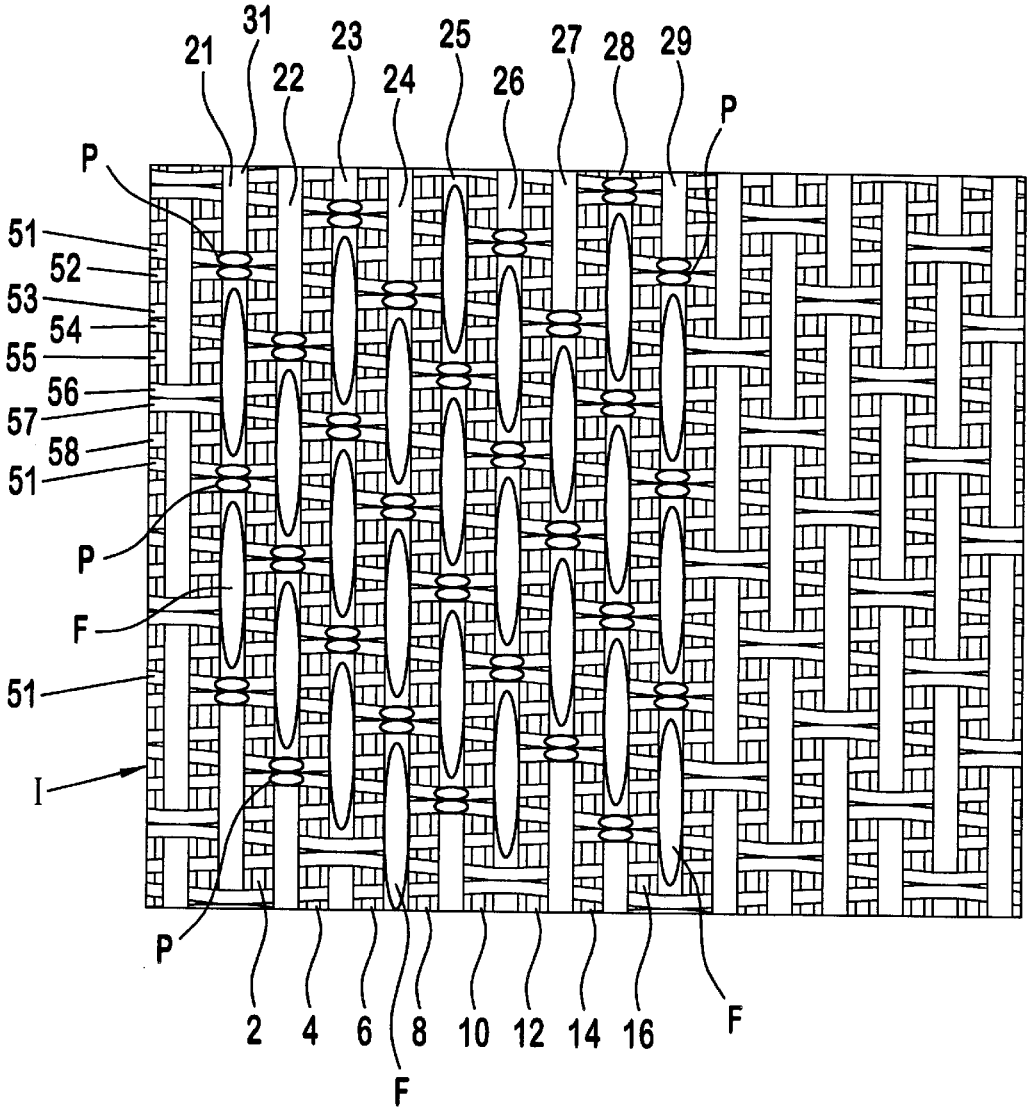
FIG. 1 is an elevated view of the machine side of a papermakers fabric made in accordance with the teachings of the present invention.

As best shown in FIG. 1, this weave pattern results in relatively long floats F of bottom layer CMD yarns 21–28 predominating the bottom surface of the fabric with MD knuckle pairs P retaining the lower layer CMD yarns 21–28 within the fabric. When weaving in knuckle pairs P under lower layer yarns 21–28, the lower layer MD yarns 51–58 tend to migrate together in a substantially contiguous relationship. This pairing both enhances fabric stability and wear resistance.

In order to maintain the separation between the lower layer MD yarns to facilitate drainage, each lower layer MD yarn 51–58 weaves a knuckle around at least two different lower layer CMD yarns 21–28 such that in one instance the lower layer MD yarn is paired with its preceding adjacent lower layer MD yarn and in another instance the lower layer MD yarn is paired with its succeeding lower layer MD yarn. For example, with respect to lower layer MD yarn 52, it is paired with preceding lower layer MD yarn 51 when weaving a knuckle under lower layer CMD yarn 21 and lower layer MD yarn 52 is paired with succeeding lower layer MD yarn 53 when weaving a knuckle under lower layer CMD yarn 24. Accordingly, the lower layer CMD yarn 52 maintains a substantially stacked relationship with upper layer MD yarn 42 to facilitate fabric drainage, even though the lower layer MD yarn 52 is not directly under upper layer MD yarn 42 when it weaves under the lower layer CMD yarns 21, 24.

Figure 4:
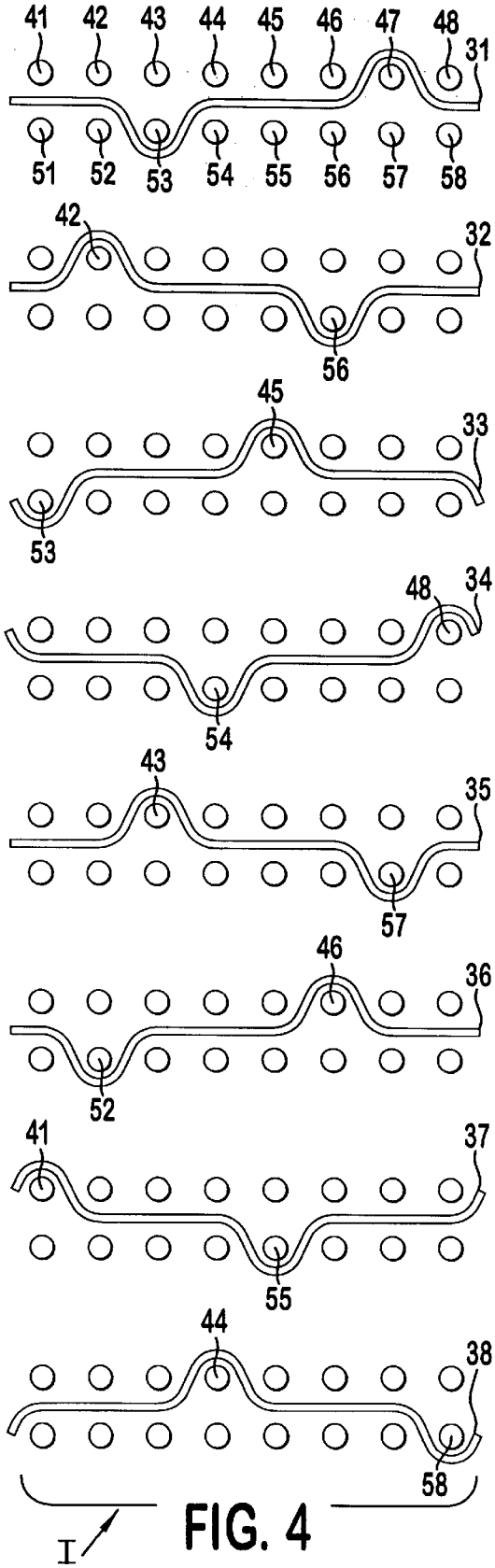
FIG. 4 is a schematic diagram of each of the stitching layer CMD yarns within a repeat of the fabric shown in FIG. 1.
Figure 5:
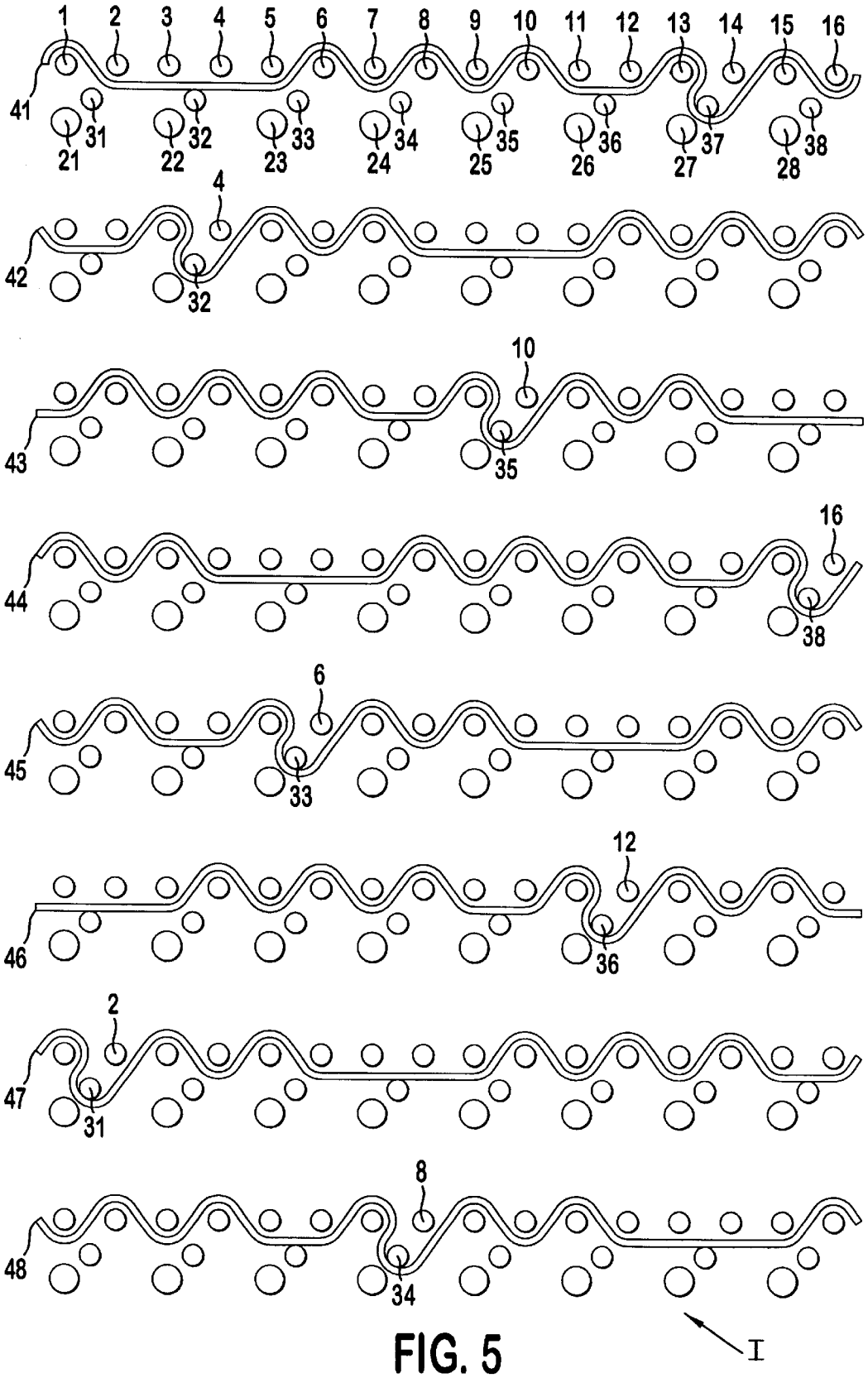
FIG. 5 is a schematic diagram of each of the upper layer MD yarns within a repeat of the fabric shown in FIG. 1.
Figure 6:
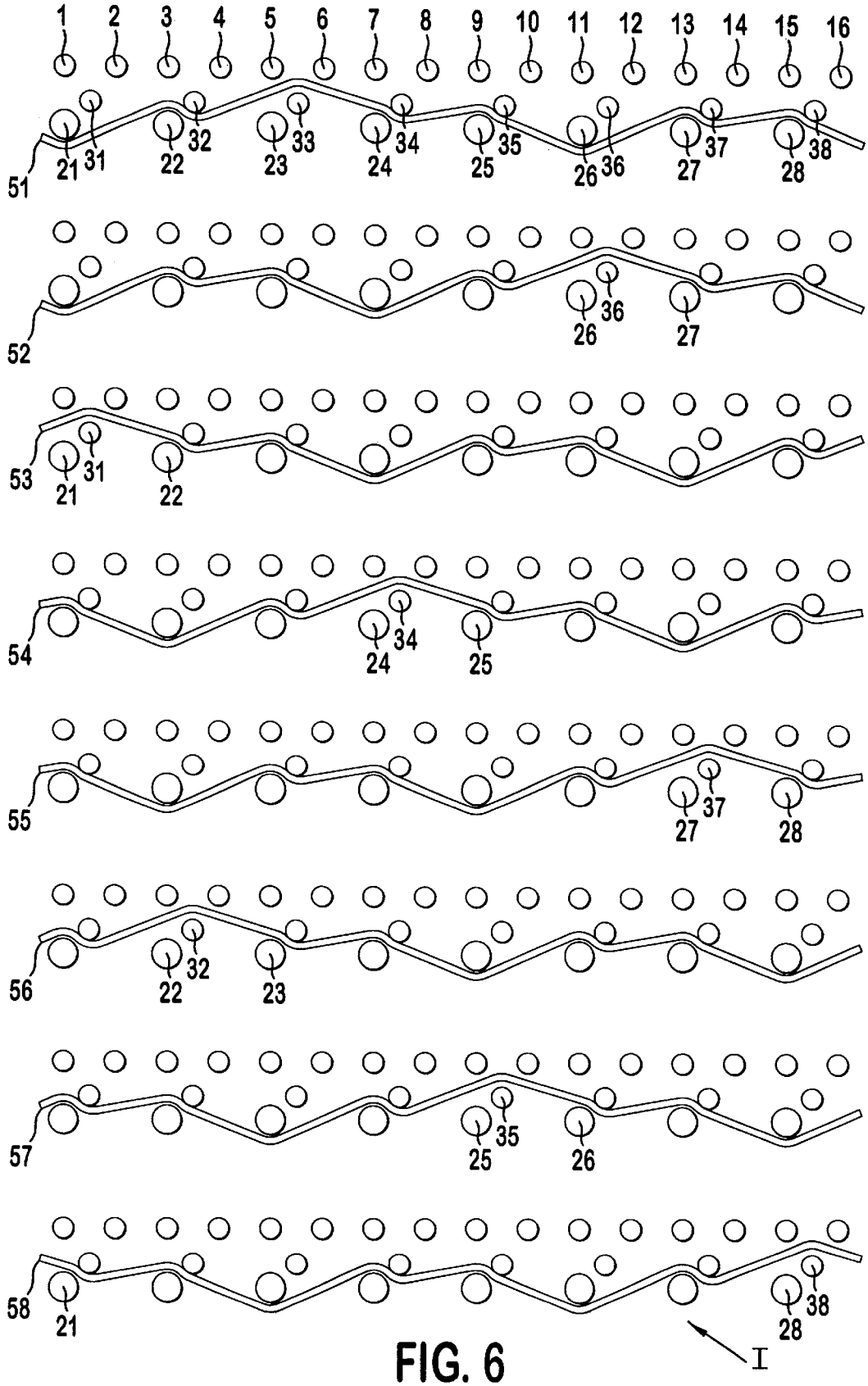
FIG. 6 is a schematic diagram of each of the lower layer MD yarns within a repeat of the fabric shown in FIG. 1.

As best seen in FIGS. 4–6, a layer of stitching yarns 31–38 interconnects the systems of interwoven upper MD and CMD yarns and interwoven lower MD and CMD yarns. Preferably, the stitching yarns have a diameter no greater than the diameter of the MD yarns. Each stitching yarn weaves under one lower MD yarn and over one upper MD yarn in its repeat. The stitching CMD yarns 31–38 are interwoven such that their interweavings with the upper and lower MD yarns are recessed within the fabric I from the surfaces defined by the upper and lower systems of interwoven MD and CMD yarns. For example, stitching yarn 31 weaves under lower layer MD yarn 53 and over upper MD yarn 47. As best seen in FIG. 5, when upper layer MD yarn 47 is weaving under stitching yarn 31, it is also weaving under upper CMD yarn 2 which blocks stitching yarn 31 from rising to the upper surface of the fabric I. As best seen in FIG. 6, when lower layer MD yarn 53 is weaving over stitching yarn 31, it is also weaving over lower larger CMD yarns 21 and 22 so that stitching yarn 31 is recessed above the bottom surface of the fabric I by at least the difference in diameters of the larger lower CMD yarns and the smaller stitching yarns. Accordingly, the stitching yarns 31–38 are protected from wear by not being exposed on the surface of either side of the fabric I.

Such protection from wear is important to prevent delamination of the fabric I. Since the stitching yarns are the only yarns which maintain the upper and lower interwoven systems of yarns together, the fabric will delaminate if the stitching yarns wear and break.

With reference to FIGS. 7–10, there is shown a second embodiment of a fabric II made in accordance with the teachings of the present invention. The fabric II is woven with a selected repeat pattern having ten upper layer CMD yarns 60–69, five lower layer CMD yarns 70–74, five stitching CMD yarns 80–84, ten upper layer MD yarns 90–99, and ten lower layer MD yarns 100–109 within each repeat of the repeated weave pattern. Preferably, all of the MD yarns 90–109 have the same diameter.

Figures 7, 8, 9:
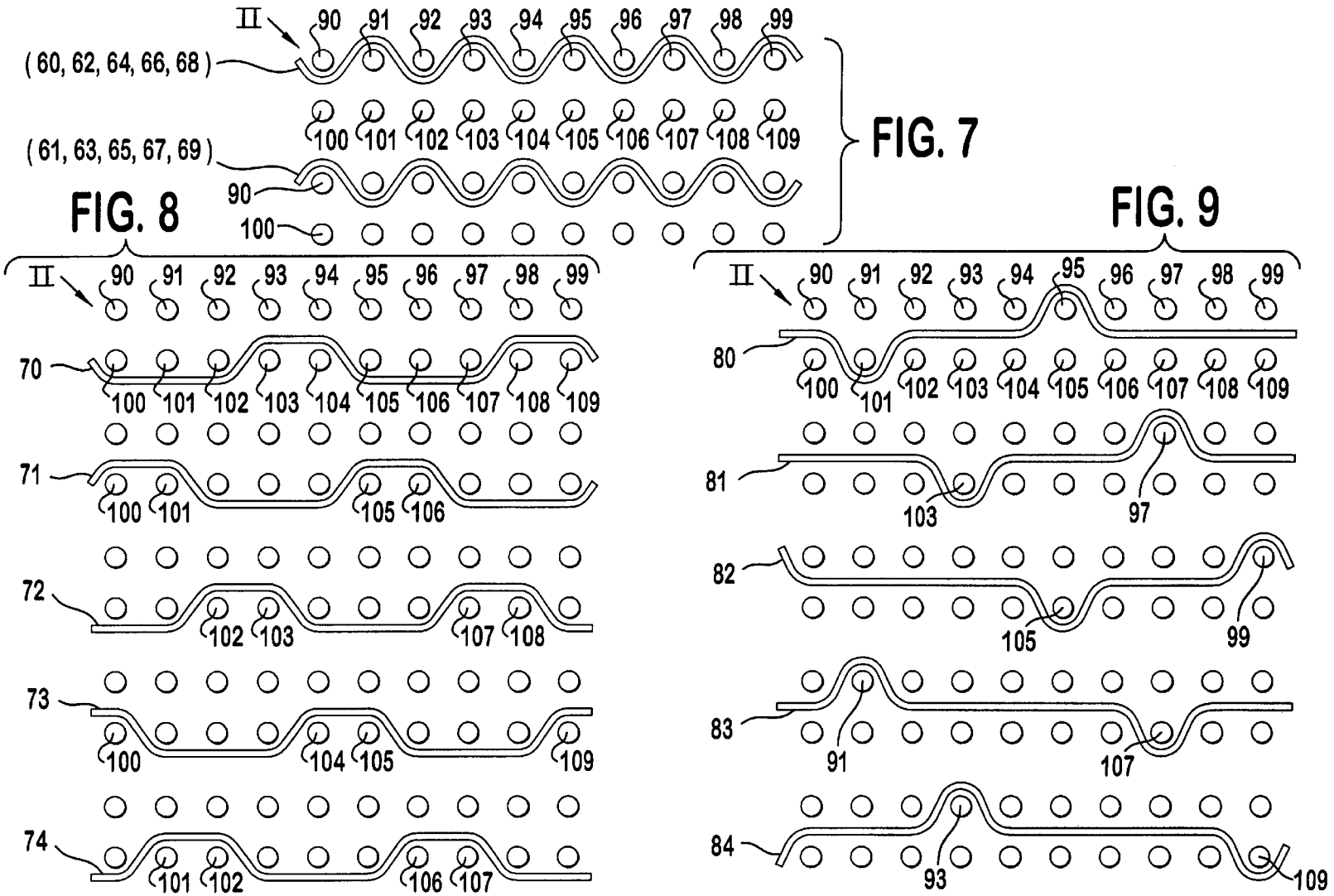
FIG. 7 is a schematic diagram of the weave pattern for upper layer CMD yarns within the repeat of a second embodiment of a fabric made in accordance with the teachings of the present invention.
FIG. 8 is a schematic diagram of each of the lower layer CMD yarns within the repeat of the fabric shown in FIG. 7.
FIG. 9 is a schematic diagram of each of the stitching layer CMD yarns within the repeat of the fabric shown in FIG. 7.

As best seen in FIG. 7, upper layer CMD yarns 60–69 interweave exclusively in a selected pattern with respect to the upper layer MD yarns 90–99 and do not interweave with the lower MD yarns 51–58. Preferably, the upper CMD yarns 60–69 weave in a plain weave such that CMD yarns 60, 62, 64, 66, 68 each weave under MD yarns 90, 92, 94, 96, 98 and over alternate MD yarns 91, 93, 95, 97, 99 and alternate CMD yarns 61, 63, 65, 67, 69 each weave over MD yarns 90, 92, 94, 96, 98 and under alternate MD yarns 91, 93, 95, 97, 99 within the repeat. Alternate weave patterns for the upper MD and CMD yarns to define the upper paper carrying surface of the fabric II can be used.

As best seen in FIG. 8, lower layer CMD yarns 70–74 interweave exclusively with the lower layer MD yarns 100–109, but do not weave with the upper layer MD yarns 90–99. The lower layer CMD yarns 70–74 are significantly larger in diameter than the MD yarns 90–109, the upper layer CMD yarns 60–69, and the stitching yarns 80–84. Additionally, there are preferably one half as many lower layer CMD yarns 70–74 as there are upper CMD yarns 60–69 within the fabric's repeat pattern. The repeat of the larger lower layer CMD yarns 70–74 is selected to predominate the bottom surface of the fabric by weaving two floats under three adjacent lower MD yarns and over two separate pairs of lower MD yarns within each repeat. For example, lower CMD yarn 70 weaves one float under lower MD yarns 100, 101, 102, a second float under lower MD yarns 105, 106, 107, and over pairs of lower MD yarns 103, 104 and 108, 109. This weave pattern results in the floats of bottom layer CMD yarns 70–74 predominating the bottom surface of the fabric II with MD knuckle pairs retaining the lower layer CMD yarns 70–74 within the fabric II. When weaving in knuckle pairs under lower layer yarns 70–74, the lower layer MD yarns 100–109 tend to migrate together in a substantially contiguous relationship. This pairing both enhances fabric stability and wear resistance.

In order to maintain the separation between the lower layer MD yarns to facilitate drainage, each lower layer MD yarn 100–109 weaves a knuckle around at least two different lower layer CMD yarns 70–74 such that in one instance the lower layer MD yarn is paired with its preceding adjacent lower layer MD yarn and in another instance the lower layer MD yarn is paired with its succeeding lower layer MD yarn. For example, with respect to lower layer MD yarn 104, it is paired with preceding lower layer MD yarn 103 when weaving a knuckle under lower layer CMD yarn 70 and lower layer MD yarn 104 is paired with succeeding lower layer MD yarn 105 when weaving a knuckle under lower layer CMD yarn 73. Accordingly, the lower layer CMD yarn 104 maintains a substantially stacked relationship with upper layer MD yarn 94 to facilitate fabric drainage, even though the lower layer MD yarn 104 is not directly under upper layer MD yarn 94 when it weaves under the lower layer CMD yarns 70, 73.

Figure 10:
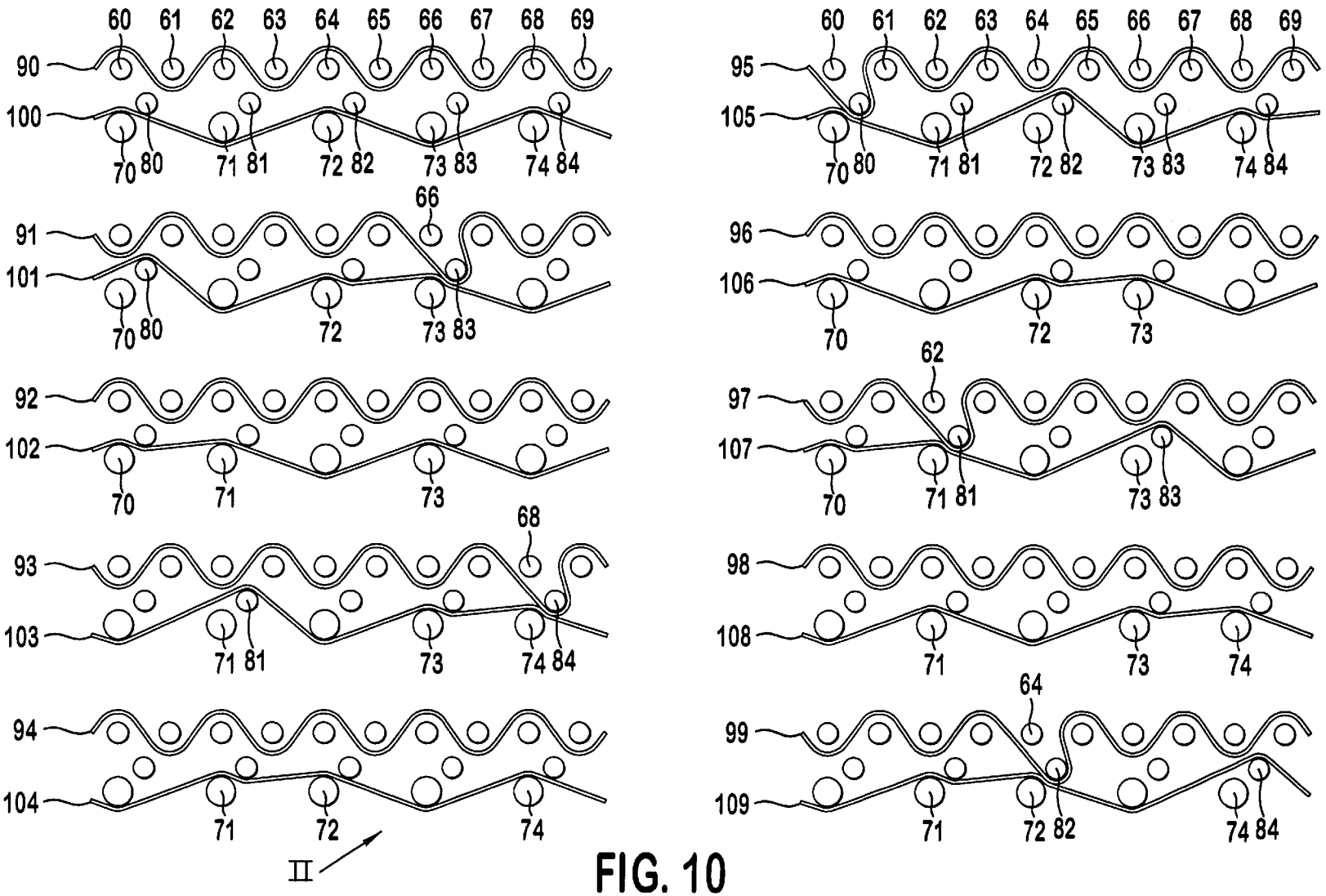
FIG. 10 is a schematic diagram of each stacked set of upper and lower layer MD yarns within the repeat of the fabric illustrated in FIG. 7.

As best seen in FIGS. 9–10, a layer of stitching yarns 80–84 interconnects the systems of interwoven upper MD and CMD yarns and interwoven lower MD and CMD yarns. Each stitching yarn weaves under one lower MD yarn and over one upper MD yarn in its repeat.

The stitching CMD yarns 80–84 are interwoven such that they are recessed within the fabric II from the surfaces defined by the upper and lower systems of interwoven MD and CMD yarns. For example, stitching yarn 80 weaves under lower layer MD yarn 101 and over upper MD yarn 95. As best seen in FIG. 10, when lower layer MD yarn 101 is weaving over stitching yarn 80, it is also weaving over lower larger CMD yarn 70 so that stitching yarn 80 is recessed above the bottom surface of the fabric due in part to the difference in diameters of the larger lower CMD yarns and the smaller stitching yarns. When upper layer MD yarn 95 is weaving under stitching yarn 80, it is also weaving under upper CMD yarn 60 which tends to block stitching yarn 80 from rising to the upper surface of the fabric II. Accordingly, the stitching yarns are protected from wear by not being exposed on either side of the fabric.

Preferably polyester yarns having a diameter in the range of 0.0035–0.0200 in. (0.09 mm–0.51 mm) are used for the MD yarns. Either polyester or nylon yarns are preferably used for the CMD yarns with preferred diameters in the ranges of 0.0035–0.0200 in. (0.09 mm–0.51 mm) for the upper layer CMD yarns, 0.0050–0.0240 in. (0.012 mm–0.61 mm) for the larger lower layer CMD yarns and 0.0035–0.0150 in. (0.09 mm–0.35 mm) for the CMD stitching yarns. The use of nylon yarns for some of the CMD yarns and polyester yarns for CMD yarns within the same class or different classes of CMD yarns may be used depending upon the specific fabric characteristics desired. Preferred combination of yarn sizes include the weaving of fabric I or II with MD and CMD yarns all having the minimum diameters specified in the above-identified ranges or all having the maximum diameters specified in the above-identified ranges. For example, a preferred fabric is woven in accordance with the repeat pattern of fabric I having all polyester yarns with all MD yarns, upper layer CMD yarns and stitching yarns having a 0.0035 in. diameter and larger lower CMD yarns having a 0.0050 diameter. Another preferred fabric is a fabric woven with the repeat pattern of fabric II having polyester, 0.0200 in. diameter MD yarns and nylon CMD yarns, the upper layer CMD yarns having a 0.0200 in. diameter, the lower CMD yarns having a 0.0240 in. diameter and the stitching yarns having a 0.0150 in. diameter.

Figure 11:
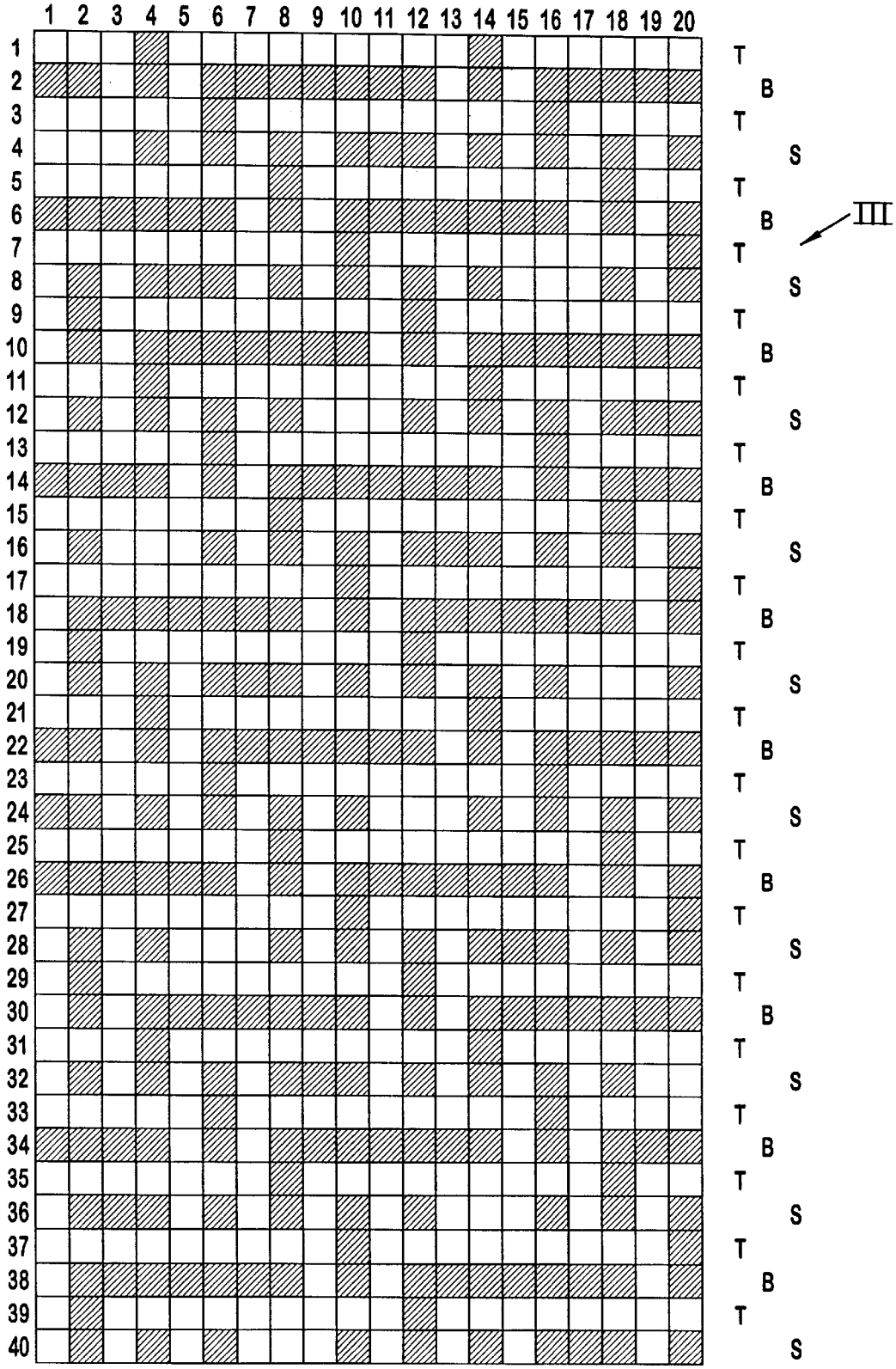
FIG. 11 is a weave chart for a repeat of a third embodiment of a fabric made in accordance with the teachings of the present invention.

With reference to FIG. 11, a weave chart for a single complete repeat of a third embodiment of a fabric III is shown. The fabric III includes twenty MD yarns numbered 1–20 across the top of the weave chart; the odd number yarns representing lower layer MD yarns and the even number yarns representing upper layer MD yarns. The fabric III has forty CMD yarns within its repeat, the upper or top layer CMD yarns identified with a T, the lower or bottom layer CMD yarns identified with a B and the stitching CMD yarns identified with an S. The fabric III, accordingly, has ten upper MD yarns, ten lower MD yarns, twenty upper CMD yarns, ten lower CMD yarns and ten stitching CMD yarns within its repeat.

Figure 12:
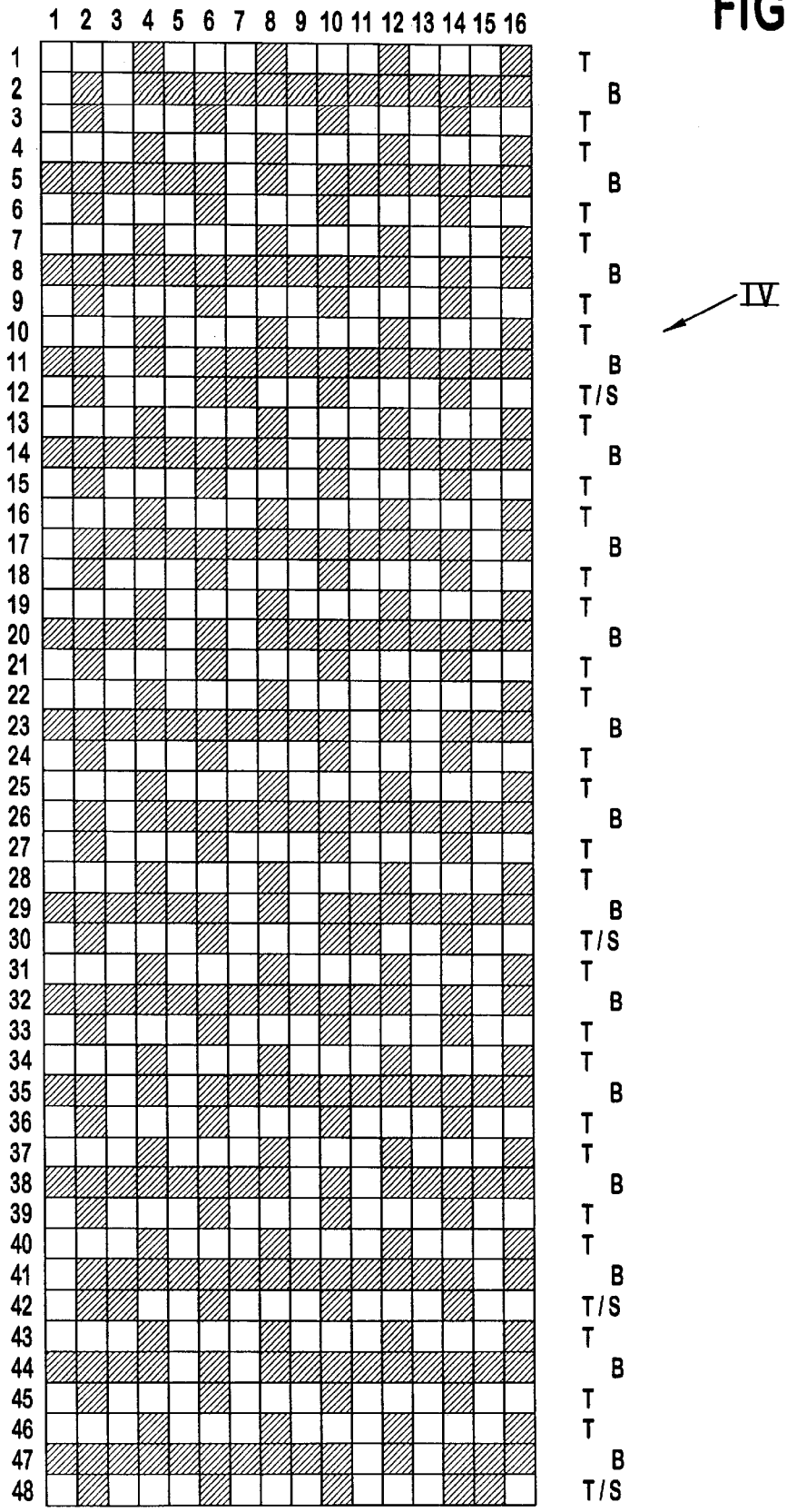
FIG. 12 is a weave chart for a repeat of a fourth embodiment of a fabric made in accordance with the teachings of the present invention.

Within the weave charts illustrated in FIGS. 11 and 12, a blackened box represents that the respective CMD yarn weaves under the respective MD yarn. For example, in the first row of boxes of FIG. 11, the fourth and fourteenth boxes are blackened. This represents that, for the fabric III, the first CMD yarn which is an upper layer CMD yarn, weaves over all of the MD yarns except the fourth and fourteenth MD yarns, which are upper layer MD yarns since they are even numbered. Also, as with the fabric II, each lower CMD yarn in the fabric III weaves over only pairs of adjacent lower MD yarns and weaves two floats under three lower MD yarns in its repeat.

With reference to FIG. 12, a weave chart for a fabric IV is shown. The repeat of fabric IV has sixteen MD yarns and forty-eight CMD yarns. Within the weave chart of FIG. 12, the MD yarns are represented by numbers 1–16 with the upper layer MD yarns being even numbers and the lower layer MD yarns being odd numbers. Unlike the other embodiments references above, the fabric IV incorporates the function of its stitching yarns into selected upper layer CMD yarns. In the fabric IV of FIG. 12, the upper or top layer CMD yarns are indicated with a T and the lower or bottom layer CMD yarns are indicated with the letter B. The letters T/S are used to identify the top layer CMD yarns which also serve as stitching yarns. Preferably, no more than half of the top layer CMD yarns function as stitching yarns.

Within the repeat pattern of the fabric of IV, there are four top layer/stitching yarns identified by chart numbers 12, 30, 42 and 48. Unlike the other top layer CMD yarns T, the four top layer/stitching CMD yarns T/S each weave under one of the bottom layer MD yarns within the repeat. Top layer/stitching CMD yarn 12 weaves under bottom MD yarn 7; top layer/stitching CMD yarn 30 weaves under bottom layer MD yarn 11, top layer/stitching CMD yarn 42 weaves under bottom layer MD yarn 3, and top layer/stitching CMD yarn 48 weaves under bottom layer MD yarn 15. The interweaving of the top layer/stitching CMD yarns T/S with the bottom layer MD yarns are adjacent to floats of bottom layer CMD yarns B so that the top layer/stitching CMD yarns interweaving with the bottom layer MD yarn is recessed from the bottom surface of the fabric which is defined by the interweaving of the lower MD yarns and lower CMD yarns.

As with the other embodiments, the lower layer CMD yarns B of the fabric IV weave over only pairs of adjacent lower MD yarns and each of the lower MD yarns weaves under at least two different lower CMD yarns B in the repeat pattern such that each lower MD yarn is paired with a preceding adjacent lower MD yarn when it weaves under one of the lower CMD yarns B and is paired with a succeeding adjacent lower MD yarn when it weaves under another of the lower CMD yarns B. For the example represented in FIG. 12, lower MD yarn 3 weaves under lower CMD yarn 2 when it is paired with preceding lower MD yarn 1, and lower MD yarn 3 weaves under lower CMD yarn 11 when it is paired with succeeding lower MD yarn 5.

Other variations within the scope and spirit of the invention will be apparent to those of ordinary skill in the art.

What is claimed is:

1. A papermakers forming fabric comprising:

an upper system of interwoven MD and CMD yarns which define a top, paper carrying surface of the fabric;

a lower system of interwoven MD and CMD yarns which define a bottom, machine side surface of the fabric;

selected upper system CMD yarns interweaving with MD yarns of both said upper and lower systems to define an integral fabric such that less than half of said upper system CMD yarns are selected yarns;

said MD yarns of both said upper and lower systems having a uniform cross section of a common selected size;

said lower system CMD yarns having a cross section size larger than said cross section size of said MD yarns; and said lower system CMD yarns woven in a repeat pattern with said lower system MD yarns such that:

all said lower system CMD yarns only weave over pairs of adjacent lower system MD yarns and only weave in floats under groups of at least three lower system MD yarns within the repeat pattern, and each of said lower system MD yarns weaves under at least two different lower system CMD yarns in the repeat pattern such that each lower system MD yarn is paired with a preceding adjacent lower system MD yarn when it weaves under one of said lower system CMD yarns and is paired with a succeeding adjacent lower system MD yarn when it weaves under another of lower system CMD yarn.

2. A papermakers fabric according to claim 1 wherein the interweavings of said selected CMD yarns with said lower system MD yarns are recessed within the fabric from said bottom surface.

3. A papermakers fabric according to claim 1 wherein the fabric has a repeat pattern having eight upper system MD yarns, eight lower system MD yarns, thirty-two upper system CMD yarns of which at least four are selected yarns, and sixteen lower system CMD yarns.

* * * * *